US006302516B1

(12) United States Patent
Brooks et al.

(10) Patent No.: US 6,302,516 B1
(45) Date of Patent: Oct. 16, 2001

(54) INK SUPPLY SYSTEM FOR INK JET PRINTHEAD

(75) Inventors: Jeffrey B Brooks, Keene; David G. Georgis, Dublin, both of NH (US)

(73) Assignee: Markem Corporation, Keene, NH (US)

( * ) Notice: Subject to any disclaimer, the term of this patent is extended or adjusted under 35 U.S.C. 154(b) by 0 days.

(21) Appl. No.: 08/782,973

(22) Filed: Jan. 14, 1997

(51) Int. Cl.[7] ..... B41J 2/165; B41J 2/175
(52) U.S. Cl. ..... 347/35; 347/85
(58) Field of Search ..... 347/85, 86, 7, 347/93, 35

(56) References Cited

U.S. PATENT DOCUMENTS

| | | | | |
|---|---|---|---|---|
| 4,162,501 | * | 7/1979 | Mitchell et al. | 347/86 |
| 4,187,511 | | 2/1980 | Robinson . | |
| 4,294,250 | * | 10/1981 | Dennehey | 604/403 |
| 4,536,777 | | 8/1985 | Matsumoto . | |
| 4,602,662 | | 7/1986 | Eremity et al. . | |
| 4,677,448 | | 6/1987 | Mizusawa et al. . | |
| 4,791,438 | | 12/1988 | Hanson et al. . | |
| 4,806,032 | * | 2/1989 | Gragg et al. | 347/87 X |
| 4,812,856 | | 3/1989 | Wallace . | |
| 4,968,998 | * | 11/1990 | Allen | 347/7 |
| 4,982,576 | * | 1/1991 | Proctor et al. | 62/292 |
| 5,367,328 | | 11/1994 | Erickson . | |
| 5,396,268 | | 3/1995 | Mader et al. . | |
| 5,409,138 | | 4/1995 | Nakano . | |
| 5,446,486 | | 8/1995 | Reis . | |
| 5,464,328 | * | 11/1995 | Stoeger | 417/44.8 |
| 5,485,187 | | 1/1996 | Okamura et al. . | |
| 5,504,510 | | 4/1996 | Miyakawa . | |
| 5,549,577 | * | 8/1996 | Siegel et al. | 604/256 |
| 5,576,749 | * | 11/1996 | Mochizuki et al. | 347/86 |
| 5,801,736 | * | 9/1998 | Ikkatai et al. | 347/86 |
| 6,024,441 | * | 2/2000 | Nishimoto | 347/85 |

FOREIGN PATENT DOCUMENTS

| | | | | |
|---|---|---|---|---|
| 3204661 A1 | * | 8/1983 | (DE) | 347/85 |
| 5-332224 | * | 12/1993 | (JP) | F02M/69/00 |
| 5-338196 | * | 12/1993 | (JP) | B41J/2/175 |

* cited by examiner

*Primary Examiner*—David F. Yockey
(74) *Attorney, Agent, or Firm*—BakerBotts, LLP

(57) ABSTRACT

An ink supply system for an ink jet printhead having an orifice plate with orifices includes an ink reservoir connected through a valve and a luer connection to an ink supply container and an air pump arranged to produce a vacuum in the ink reservoir to draw ink form the ink supply container into the ink reservoir. The ink reservoir has an ink sensor to detect a desired ink level in the reservoir and to detect a low ink condition along with a control unit which controls the operation of the air pump for a predetermined period established by the control unit in response to signals from the sensor. A restricted passage connects the ink reservoir to the atmosphere through a filter so that the ink in the reservoir is maintained at atmospheric pressure and the level of the ink in the reservoir is selected to provide a desired negative liquid pressure head at the orifices in the ink jet printhead. In addition, a purge reservoir is connected to a supply line leading from the ink reservoir to the printhead and an air pump is arranged to apply air pressure to the purge reservoir and a solenoid valve in the line between the purge reservoir and the ink reservoir is closed for ink refill and purging. As in the ink reservoir, the purge reservoir is connected to the atmosphere through a restricted passage and a filter.

14 Claims, 2 Drawing Sheets

INK SUPPLY SYSTEM FOR INK JET PRINTHEAD

BACKGROUND OF THE INVENTION

This invention relates to ink supply systems for ink jet printheads.

In many ink jet printheads it is important to maintain a negative pressure at the orifices from which ink is ejected in order to avoid weeping of ink from the orifices when the printhead is not operating. In addition, it is occasionally necessary to purge the printhead by ejecting ink under pressure through the printhead. It is also necessary in many cases to refill the reservoir from which ink is supplied to the printhead from a remote ink supply periodically in order to maintain a desired level of ink in the ink reservoir and to provide a remote ink supply which can be quickly and easily connected to the printhead in an inexpensive manner.

Certain prior art arrangements such as those described in the Robinson U.S. Pat. No. 4,187,511, the Matsumoto U.S. Pat. No. 4,536,777, the Eremity et al. U.S. Pat. No. 4,602,662 and the Mizusawa et al. U.S. Pat. No. 4,677,448 provide a remote ink supply from which ink is drawn to a reservoir for an ink jet head by a vacuum arrangement but these arrangements are complex and expensive. In other prior art arrangements such as described, for example, in the Okamura et al. U.S. Pat. No. 5,485,187, the ink level in the reservoir from which ink is supplied to a printhead is maintained at a desired spacing below the orifices in the printhead so as to produce a desired negative pressure at the orifices in the ink jet head and positive pressure may be applied for purging but the level of ink in a remote ink supply must be the same as the level of ink in the reservoir. The prior art, moreover, does not disclose a simple and inexpensive dual reservoir ink supply system for an ink jet printhead in which the ink in the reservoir can maintained at a desired level while permitting convenient replenishment of the reservoir from a remote ink supply which may be disposed at any level and also providing for purging of the printhead in a convenient manner, nor does it provide a simple and convenient arrangement for connecting and removing a remote ink supply.

SUMMARY OF THE INVENTION

Accordingly, it is an object of the present invention to provide a dual reservoir ink supply system for ink jet printheads which overcomes the disadvantages of the prior art.

Another object of the invention is to provide a dual reservoir vacuum ink supply system for an ink jet printhead in which the ink in an ink reservoir supplying ink to the printhead is normally maintained at a desired level while providing for purging of the printhead when necessary and for replenishment of the ink reservoir in a convenient and inexpensive manner.

These and other objects of the invention are attained by providing an ink supply system including an ink reservoir connectable to a remote ink supply and an air pump connected to the ink reservoir by which a vacuum may be applied to draw ink from the remote ink supply through a valve into the ink reservoir. The ink reservoir includes an ink sensor to detect the presence of ink at a desired level in the reservoir and the ink supply system also includes a purge reservoir in which ink is normally maintained at the same level as in the ink reservoir and to which pressure may be applied to purge the printhead when another valve connecting the purge reservoir and the ink reservoir is closed.

Preferably, an air pump is provided to apply vacuum to the ink reservoir for replenishment from the remote ink supply and another air pump is provided to apply pressure to the ink in the purge reservoir when purging is required. The valves controlling communication between the reservoirs are preferably solenoid valves. To permit convenient replacement of the remote ink supply, a friction fit luer connection may be used.

BRIEF DESCRIPTION OF THE DRAWING

Further objects and advantages of the invention will be apparent from a reading of the following description in conjunction with the accompanying drawings in which.

DESCRIPTION OF PREFERRED EMBODIMENTS

Figure 1:
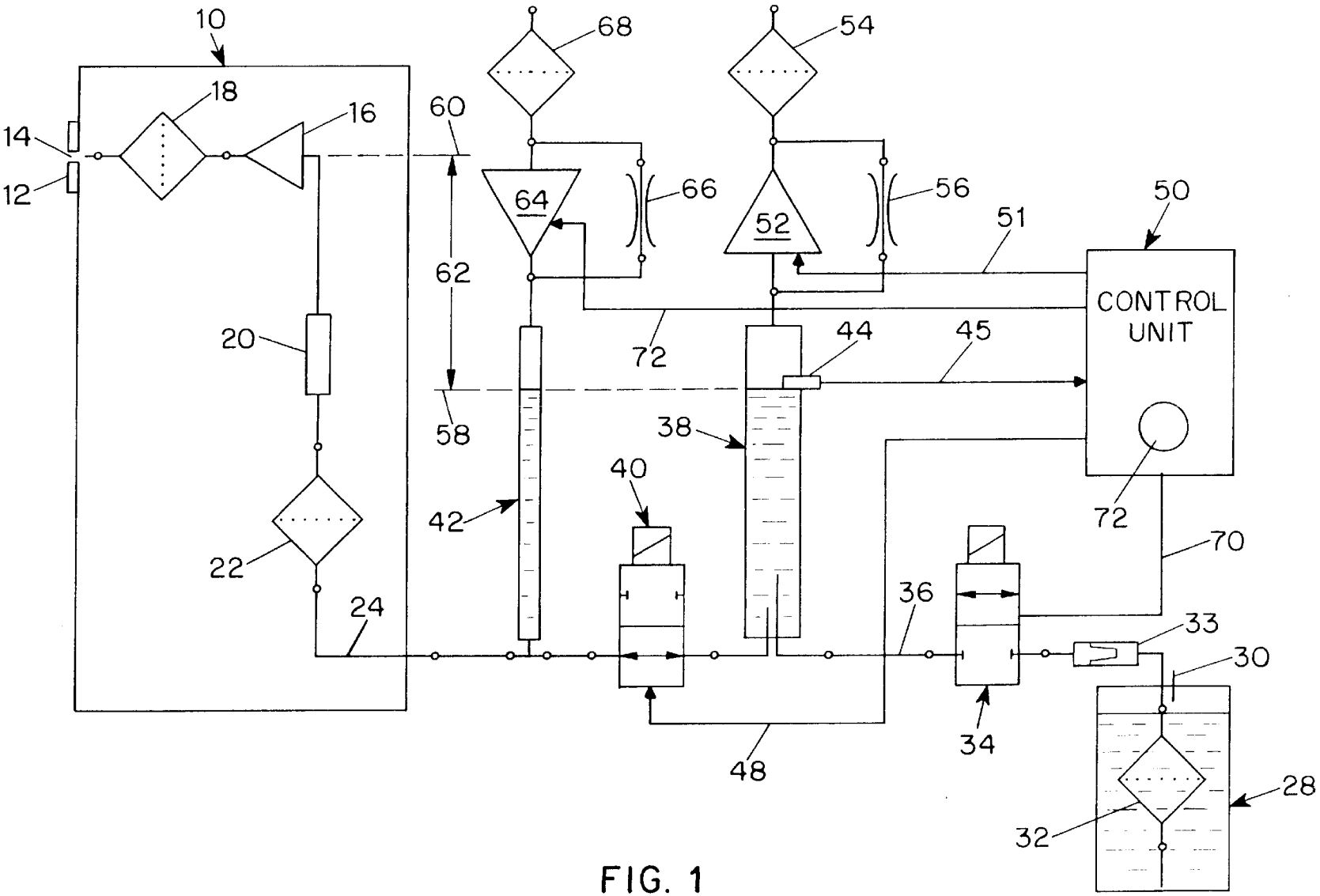
FIG. 1 is a schematic diagram illustrating a representative embodiment of an ink supply system for an ink jet printhead arranged in accordance with the invention.

In the typical embodiment of the invention illustrated in FIG. 1, an ink jet printhead 10 has an orifice plate 12 formed with orifices 14 from which ink drops are selectively ejected in response to pressure pulses applied to the ink in a corresponding ink pressure chamber 16 which is schematically illustrated in the drawing. A filter 18 interposed between the pressure chamber 16 and the orifices 14 is designed to trap solid particles which are large enough to block the orifices 14 but to permit smaller solid particles to pass to the orifice as described, for example, in the copending Moynihan application Ser. No. 08/231,102, filed Apr. 22, 1994, the disclosure of which is incorporated herein by reference. Each pressure chamber 16 receives ink from an internal printhead manifold 20 which is, in turn, supplied with ink through a filter 22 connected to an ink receiving line 24.

To provide ink for the ink jet printhead 10, a remote ink supply unit 28 having an air vent 30 and an ink filter 32 is connected through a luer connector 33 to a normally closed solenoid valve 34 leading to an ink supply line 36. If desired, the solenoid valve 34 may be replaced by a check valve oriented to prevent ink from flowing from the line 36 to the ink supply unit 28.

The internal filter 32 in the ink supply unit 28 is provided to protect the printhead in case any contamination should be introduced into the ink that would cause the printhead to fail and also to filter out any solid material introduced into the ink supply unit during manufacture and assembly. This avoids the necessity for cleaning the supply container and filling the supply unit in a clean environment.

The luer connector 33 forms a tight friction fit between tapered close-fitting male and female parts, thereby providing a convenient and inexpensive structure by which the ink supply unit 28 may be readily connected and disconnected from the system.

Figure 2:
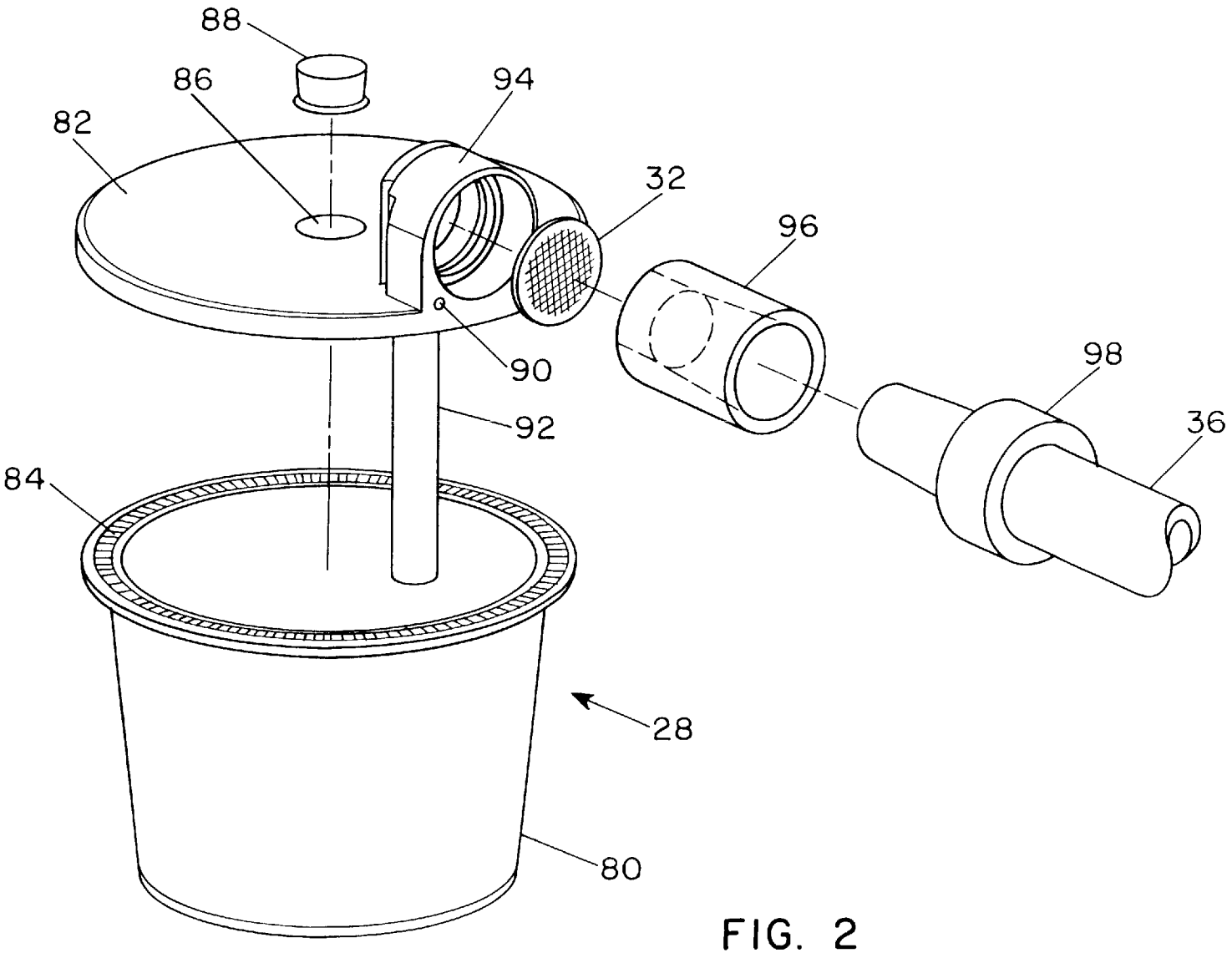
FIG. 2 is a perspective and exploded view illustrating a representative embodiment of a remote ink supply unit.

A representative embodiment of a remote ink supply unit 28 according to the invention is illustrated in FIG. 2. In that embodiment the ink supply unit consists of a plastic cup 80 and a plastic cover 82 sealed to the cup by ultrasonic welding around the rim 84 of the cup. The cover 82 has an opening 86 in which a filler plug 88 is similarly welded after the unit has been filled with ink.

In addition, a tube 92 extends to the bottom of the cup from a connector housing 94 formed in the cover and an air vent 90 is provided in the housing 94. The filter 32 is inserted into the connector housing and a plastic female luer connector 96 and is then sealingly affixed in the connector housing, for example by ultrasonic welding, to complete the assembly of the ink supply unit 28. For installation in an ink jet system, a male luer connector 98 at the end of the ink supply line 36 leading to the printhead is friction-fitted to the female connector 96 in the manner shown in FIG. 1. Preferably, the male luer connector 98 is made of stainless steel.

The ink supply line 36 is connected to a vacuum reservoir 38 and is also connected through a normally open solenoid valve 40 to a purge reservoir 42 and to the printhead ink receiving line 24. Within the vacuum reservoir 38 an ink level sensor 44 is provided to control the level of ink in the reservoir. In order to replenish the ink supply in the vacuum reservoir 38, a control unit 50 responds to detection of a low ink level in the reservoir as represented by a signal supplied on a line 45 from the detector 44 by sending signals through a line 70 to open the solenoid valve 34, through a line 51 actuate an air pump 52 which pumps air out of the reservoir 38, and through a line 48 to close the solenoid valve 40. This creates a vacuum in the vacuum reservoir which draws ink from the remote ink supply unit 28 through the open valve 34 into the vacuum reservoir.

When a predetermined time period sufficient to refill but not overfill the vacuum reservoir has elapsed, the air pump 52 is turned off and the valves 34 and 40 are returned to their normal state. The remaining vacuum in the reservoir draws air from the atmosphere through a filter 54 and a restricted passage 56 back into the reservoir so that the ink in the reservoir is maintained at atmospheric pressure. The restricted passage 56, which may, for example, be an orifice of about 0.01 inch diameter or may be a reduced diameter conduit section, bypasses the air pump 52 and provides an air flow rate low enough to prevent short circuiting of the air pump 52 during operation but high enough to cause the ink in the reservoir 38 to be maintained at atmospheric pressure during use of the printhead.

The air pump 52 may be, for example, a simple and inexpensive diaphragm pump of the type used to supply air to aquariums which produces a negative air pressure adequate to draw ink from the ink supply unit 28 through the filter 32 when the ink supply is positioned up to twelve inches or more below the reservoir 38.

If the ink has not reached the level of the sensor 44 after one or two pump operating cycles, indicating that the remote ink supply unit 28 is empty, the control unit 50 activates a signal 72 to alert the operator to replace the remote ink supply unit.

In order to control the pressure in the ink at the orifice 14 at a desired negative level to prevent it from weeping from the orifice, the ink sensor 44 in the vacuum reservoir is located at a level 58 which is below the level 60 of the orifice 14 by a distance 62 which may be, for example, about one to four inches to produce a corresponding negative pressure of about one to four inches, water gauge, in the orifice 14.

The purge reservoir 42 is connected to an air pump 64 which is similar to the air pump 52 but oriented in the opposite direction so as to apply pressure to the air in the purge reservoir during operation. A restricted passage 66, which may be an orifice of about 0.01 inch diameter or a reduced diameter conduit section, bypasses the air pump and leads to a filter 68 through which the purge reservoir is connected to the atmosphere to prevent contamination by air drawn into the reservoir. As in the case of the restricted passage 56, the passage 66 is small enough to prevent short circuiting of the air pump 64 but large enough to permit the ink in the purge reservoir 42 to be maintained at atmospheric pressure during operation of the system. Consequently, as long as the solenoid valve 40 remains open and neither of the air pumps 52 and 64 is operating, the level of the ink in the purge reservoir 42 will be the same as that in the vacuum reservoir 38 after any ink flow between the reservoir stops.

If it is necessary to purge ink from the printhead 10 to clear the orifices 14 and related ink passages in the printhead, the normally open solenoid valve 40 is closed by a signal on a line 70 from the control unit 50 and operation of the air pump 64 is initiated by a signal on a line 72 so as to apply pressure to the ink in the purge reservoir 42, causing the pressure of the ink in the printhead to be increased and thereby forcing ink out of the orifices in the orifice plate and the adjacent passages within the printhead so as to clear those passages of air bubbles or debris.

Since the air pumps 52 and 64 may be simple and inexpensive diaphragm pumps the ink supply system of the invention eliminates the complexity and expense of piston-type pumps which require a piston moving in fluid-tight relation to a cylinder such as have been used in conventional ink supply systems to transfer ink from a remote ink supply to an ink reservoir. As noted above, the negative air pressure generated by such air pumps is high enough to cause ink to be drawn upwardly from an ink supply which is substantially below the level of the ink reservoir and through any necessary ink filter so that the remote ink supply can be located anywhere in the apparatus. Moreover, attachment and removal of the ink supply unit 28 can be accomplished in a quick and inexpensive way by the use of the luer connection.

Although the invention has been described herein with reference to a specific embodiment, many modifications and variations therein will readily occur to those skilled in the art. Accordingly, all such variations and modifications are included within the intended scope of the invention.

What is claimed is:

1. An ink supply arrangement for an ink jet printhead comprising:

an ink reservoir connected to the ink jet printhead to supply ink to the ink jet printhead and having an ink inlet opening and an air outlet opening;

an ink supply container connected to the ink inlet opening in the ink reservoir through a supply valve arranged to prevent ink from passing from the ink reservoir to the ink supply container;

a vacuum pump connected between atmosphere and the air outlet opening in the ink reservoir and responsive to a signal indicating a low ink level in the reservoir to generate a vacuum in the reservoir for a predetermined period of time established by a control unit to draw ink from the ink supply container into the ink reservoir during operation of the vacuum pump, and a filter through which the air outlet opening communicates with the atmosphere.

2. An ink supply arrangement according to claim 1 wherein the supply valve is a solenoid valve.

3. An ink supply arrangement according to claim 1 wherein the supply valve is a check valve.

4. An ink supply arrangement according to claim 1 including:

a filter in the ink supply container to prevent solid contaminants in the ink therein from passing to the ink reservoir when ink is drawn into the ink reservoir from the ink supply container.

5. An ink supply arrangement according to claim 1 including:

an ink level sensor in the ink reservoir; and a control unit connected to the vacuum pump and the ink level sensor for controlling the operation of the vacuum pump in accordance with signals received from the ink level sensor.

6. An ink supply arrangement according to claim 1 including:

an ink intake line connecting the ink supply container to the supply valve; and a luer connector in the ink intake line to facilitate attachment and removal of the ink supply container.

7. An ink supply arrangement for an ink jet printhead comprising:

an ink reservoir connected to the ink jet printhead to supply ink to the ink jet printhead;

an ink supply container connected to the ink reservoir through a supply valve arranged to prevent ink from passing from the ink reservoir to the ink supply container;

a vacuum pump connected to the ink reservoir to generate a vacuum in the reservoir to draw ink from the ink supply container into the ink reservoir; and a restricted air passage bypassing the vacuum pump and open to atmosphere to maintain the ink in the reservoir at atmospheric pressure when the vacuum pump is not operating.

8. An ink supply arrangement according to claim 7 including:

a filter through which the restricted passage communicates with the atmosphere.

9. An ink supply arrangement for an ink jet printhead comprising:

an ink reservoir connected to the ink jet printhead to supply ink to the ink jet printhead and having an ink inlet opening and an air outlet opening;

an ink supply container connected to the ink inlet opening in the ink reservoir through a supply valve arranged to prevent ink from passing from the ink reservoir to the ink supply container;

a vacuum pump connected between atmosphere and the air outlet opening in the ink reservoir to generate a vacuum in the reservoir to draw ink from the ink supply container into the ink reservoir during operation of the vacuum pump and including:

an ink supply line connecting the ink reservoir to the ink jet printhead;

a purge reservoir connected to the ink supply line;

a normally open valve in the ink supply line between the purge reservoir and the ink reservoir; and control means for closing the normally open valve during purging and when a vacuum is generated in the ink reservoir.

10. An ink supply arrangement according to claim 9 including:

a further pump arranged to supply air under pressure to the purge reservoir to apply pressure to the ink in the supply line and in an ink jet printhead connected to the supply line so as to cause ink in the printhead to be ejected through ink jet orifices therein.

11. An ink supply arrangement for an ink jet printhead comprising:

an ink reservoir connected to the ink jet printhead to supply ink to the ink jet printhead;

an ink supply container connected to the ink reservoir through a supply valve arranged to prevent ink from passing from the ink reservoir to the ink supply container;

an air pump connected to the ink reservoir to generate a vacuum in the reservoir to draw ink from the ink supply container into the ink reservoir;

an ink supply line connecting the ink reservoir to the ink jet printhead;

a purge reservoir connected to the ink supply line;

a normally open valve in the ink supply line between the purge reservoir and the ink reservoir;

control means for closing the normally open valve during purging and when a vacuum is generated in the ink reservoir;

a further air pump arranged to supply air under pressure to the purge reservoir to apply pressure to the ink in the supply line and in an ink jet printhead connected to the supply line so as to cause ink in the printhead to be ejected through ink jet orifices therein; and a restricted passage connecting the purge reservoir to the atmosphere and bypassing the further air pump.

12. An ink supply arrangement according to claim 11 including:

a filter between the purge reservoir and atmosphere through which the purge reservoir communicates with the atmosphere.

13. An ink supply arrangement: for an ink jet printhead comprising:

an ink reservoir connected to the ink jet printhead to supply ink to the ink jet printhead;

an ink supply container connected to the ink reservoir through a supply valve arranged to prevent ink from passing from the ink reservoir to the ink supply container;

an air pump connected to the ink reservoir to generate a vacuum in the reservoir to draw ink from the ink supply container into the ink reservoir;

a low ink level sensor in the ink reservoir; and a control unit connected to the air pump and the low ink level sensor for controlling the operation of the air pump in accordance with signals received from the low ink level sensor;

wherein the control unit controls the operation of the air pump to cause ink to be drawn into the ink reservoir for a predetermined time period established by the control unit after the low ink level sensor transmits a low ink level signal to the control unit.

14. An ink supply arrangement according to claim 13 wherein a level of ink in the ink reservoir detected by the ink level sensor is located at a position below a level of an orifice in the ink jet printhead to provide a desired negative liquid pressure head at the orifice in the ink jet head.

* * * * *